United States Patent [19]

Pugh et al.

[11] 4,109,908

[45] Aug. 29, 1978

[54] FOREARM MOUNTED SUPPORT FOR LIFT WEIGHTS

[76] Inventors: Daniel B. Pugh, 40 Highland St., Medway, Mass. 02053; Thomas M. Cataldo, 59 Highwood Dr., Franklin, Mass. 02038

[21] Appl. No.: 656,697

[22] Filed: Feb. 9, 1976

[51] Int. Cl.[2] ..... A63B 23/00

[52] U.S. Cl. ..... 272/119

[58] Field of Search ..... 272/117, 116, 122, 123, 272/119, 67, 57 R, 57 D, 94, 139, 119

[56] References Cited

U.S. PATENT DOCUMENTS

| | | | |
|---|---|---|---|
| 1,047,212 | 12/1912 | Hamilton | 272/119 |
| 2,263,135 | 11/1941 | Johnson | 272/122 X |
| 2,617,650 | 11/1952 | Landis | 272/122 |
| 3,149,839 | 9/1964 | Materia | 272/119 X |
| 3,370,850 | 2/1968 | Moore | 272/119 |

*Primary Examiner*—William R. Browne

*Attorney, Agent, or Firm*—Clarence A. O'Brien; Harvey B. Jacobson

[57] ABSTRACT

An elongated body is provided including first and second opposite sides. A shank-type handgrip projects endwise outwardly from one side of the body at one end thereof and a forearm encircling open frame projects outwardly of the same side of the body at the other end thereof. An elongated shank-type weight support structure projects endwise outwardly of the other side of the body centrally intermediate the opposite ends thereof and is adapted to have conventional apertured disc-type weights mounted thereon. The apparatus comprising the body, the handgrip, the frame and the shank-type weight supporting structure is adapted to be used by a person wishing to exercise his upper arms and shoulders and to develop the "forearm blow" utilized in high school, college and professional football blocking.

1 Claim, 4 Drawing Figures

FOREARM MOUNTED SUPPORT FOR LIFT WEIGHTS

BACKGROUND OF THE INVENTION

Various forms of weight supporting devices designed for use in developing upper arm and shoulder portions of the user have been heretofore designed. However, these previously known exercising devices have not been primarily designed for use in developing the above-mentioned "forearm blow" and many previously designed weight supporting devices of a similar nature have not been readily adaptable for use by persons of young age and adult age requiring light- and heavy-weighting, respectively.

Examples of various forms of previously patented weight supporting structures are disclosed in U.S. Pat. Nos. 348,379, 1,729,209, 2,482,589, 2,504,880 and 3,180,641.

BRIEF DESCRIPTION OF THE INVENTION

The weight support of the instant invention is adapted to be partially supported by the central forearm portion of the user as well as by the hand of the user and is capable of representing exercise weights of between 5 and 55 pounds, the support along weighing 5 pounds and being capable of having 50 pounds of weight supported therefrom.

The weight support includes an elongated body having an outstanding open frame at one end for receiving the mid-portion of the user's forearm therethrough and the other end of the body is provided with an outstanding handgrip with the mid-portion of the body provided with a weight supporting shank. The weight support may be used singly in exercising one arm or shoulder at a time or a pair of the weight supports may be utilized in simultaneously exercising the arms or shoulders of the user.

The main object of this invention is to provide a weight supporting apparatus specifically designed to enable the user to develop the "forearm blow" utilized in high school, college and professional football blocking.

Another important object of this invention is to provide an exercising apparatus constructed in a manner so as to be readily usable by persons of different sizes.

A further object of this invention is to provide a weight supporting apparatus constructed in a manner whereby the apparatus may not be freely dropped from engagement by the user.

Another very important object of this invention is to provide a weight supporting exercise apparatus specifically adapted to exercise and develop both the upper arm muscles and the shoulder muscles as well as various other muscles of the body.

A final object of this invention to be specifically enumerated herein is to provide a weight supportive exercising apparatus which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
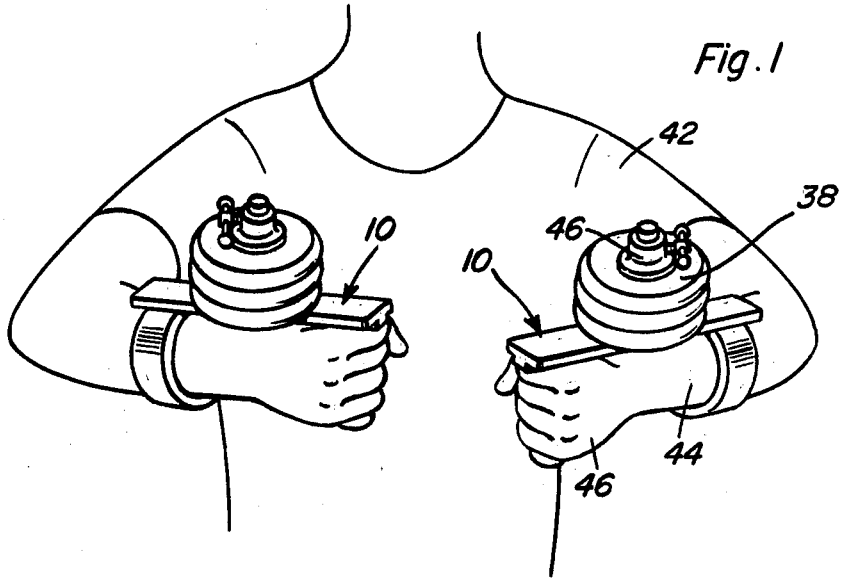
FIG. 1 is a perspective view with a pair of the weight supports of the instant invention being used by a person for exercising his upper arms and shoulders.
Figure 2:
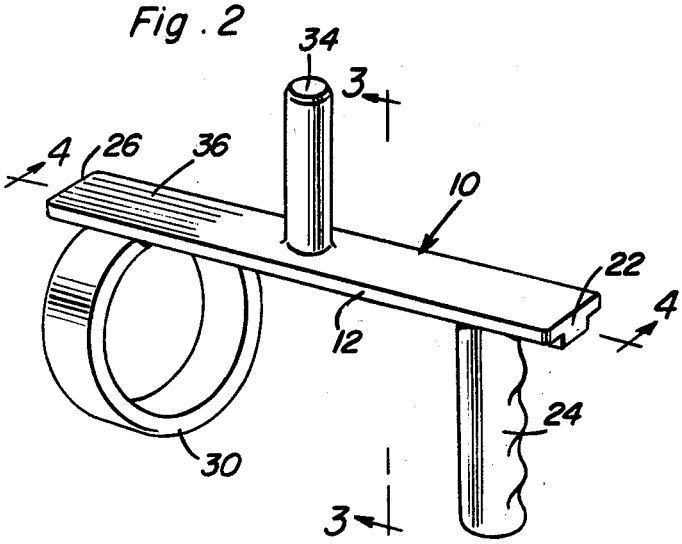
FIG. 2 is an enlarged perspective view of one of the weight supports.
Figure 3:
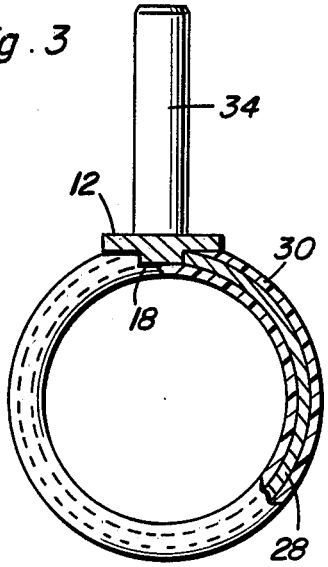
FIG. 3 is a fragmentary enlarged vertical sectional view taken substantially upon the plane indicated by the section line 3—3 of FIG. 2.
Figure 4:
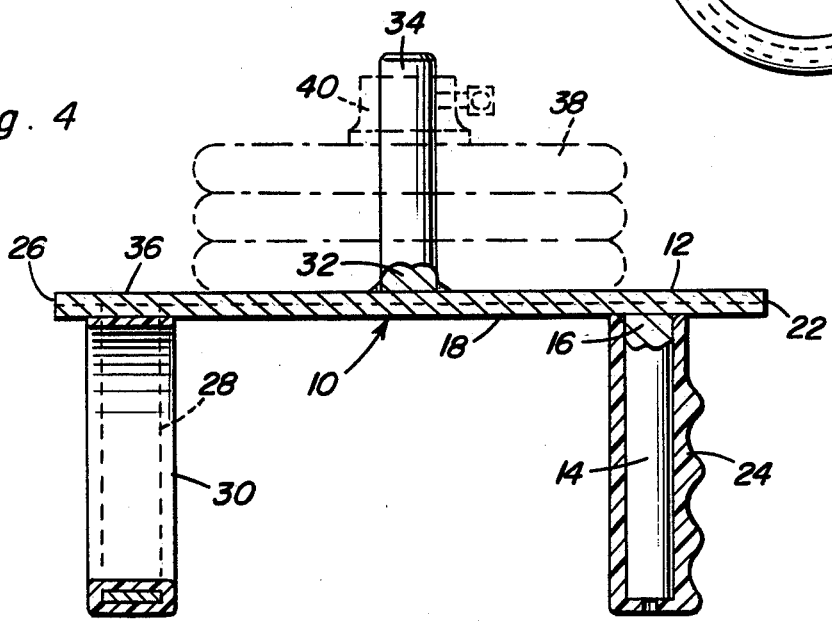
FIG. 4 is an enlarged longitudinal vertical sectional view taken substantially upon the plane indicated by the section line 4—4 of FIG. 2.

Referring now more specifically to the drawings, the numeral 10 generally designates the weight support of the instant invention. The support 10 includes an elongated body 12 provided with a cylindrical handle 14 at one end having one end 16 thereof secured to one side 18 of the body 12 a spaced distance from one terminal end 22 of the body 12. The handle 14 has a conventional tubular handgrip 24 telescoped thereover.

The body 12 includes a second terminal end 26 a spaced distance from which a closed periphery cylindrical frame 28 is supported. The outer side of one peripheral portion of the frame 28 is secured to the one side 18 of the body 12 a spaced distance from the terminal end 26 and with the frame 28 disposed in a plane substantially normal to the longitudinal centerline of the body 12. The frame 28 is covered by a padded covering 30 throughout its entire periphery, except for those portions of the frame 28 secured directly to the body 12.

The longitudinal mid-portion of the body 12 has one end 32 of a cylindrical weight support shank 34 secured thereto with the weight support shank 34 projecting endwise outwardly from the other side 36 of the body 12 and disposed at generally right angles to the longitudinal centerline of the body.

The frame 28 is constructed of strap material approximately ¼ inch in diameter and the outside diameter of the frame 28 is approximately 2½ inches. The handle 14 is secured by welding to the handle 12 as are the weight support shank 34 and the frame 28. The weight support shank is approximately 4 inches in length and 1 inch in diameter and the shank is therefore of sufficient size to have approximately 50 pounds of conventional weight discs 38 mounted thereon and secured in position by means of a retaining collar 40.

In use, the support 10 has the frame 28 thereof slipped over the forearm of the user 42 in the manner illustrated in FIG. 1 of the drawings and with the body 12 extending along the upper surface of the forearm 44. Then, the handgrip 24 is gripped by the hand 46 of the user, it being understood that an appropriate number of weight discs 38 having been mounted on the shank 34 prior to application of the support 10 to the forearm 44. After one or two of the supports 10 have been supported from the forearms 44 of the user and gripped by his hands 46, various arm movements may be carried out in order to exercise specific muscles of the upper arm and the shoulder.

If it is desired, the weight support 10 may be constructed of strong plastic, especially if it is to be used by young persons who will not have appreciable amounts of weight discs 38 supported from the shank 34. Further, the overall length of the body 12 is approximately 12 inches thereby adapting the support 10 for use by persons of different sizes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An exercise weight supportive assembly, said assembly including a single one-piece elongated body having a pair of opposite side longitudinal sides, said body including only one elongated plate-like member, only one elongated weight supporting shank supported from only one of said longitudinal sides of said body with one end of said shank abutted against and permanently anchored relative to said one side centrally intermediate the opposite ends of said body and the other end of said shank projecting endwise outwardly from said one longitudinal side and adapted to have annular weights removably telescoped thereover, an elongated hand grip having one end abutted against and permanently anchored relative to one end portion of the other longitudinal side of said body with the other end of said hand grip projecting endwise outwardly from said other longitudinal side, an annular forearm receiving and engaging frame member including a peripheral portion thereof permanently anchored to said other longitudinal side adjacent the other end of said body with said annular frame member disposed in a plane substantially normal to said elongated body, the portions of said hand grip and annular frame member remote from said elongated body member being free of connecting members extending and secured therebetween, said frame and hand grip each having the exposed surfaces thereof covered by means of resilient covering material.

* * * * *